United States Patent [19]

Downing et al.

[11] Patent Number: 4,500,223

[45] Date of Patent: Feb. 19, 1985

[54] CARRIER FOR HINGED SUPPORT OF PAGES

[75] Inventors: Gerald T. Downing, Port Washington; Karl P. Schaefer, Brookfield, both of Wis.

[73] Assignee: W. H. Brady Co., Milwaukee, Wis.

[21] Appl. No.: 531,883

[22] Filed: Sep. 14, 1983

[51] Int. Cl.[3] ..... B42F 3/02; B42F 13/02

[52] U.S. Cl. ..... 402/20; 402/80 P

[58] Field of Search ..... 402/19, 20, 21, 22, 402/23, 80 R, 80 P

[56] References Cited

U.S. PATENT DOCUMENTS

| | | | |
|---|---|---|---|
| 294,775 | 3/1884 | Elam | 402/20 X |
| 1,238,410 | 8/1917 | Landsberg et al. | 402/20 X |
| 2,363,848 | 11/1944 | Emmer | 402/20 X |
| 2,878,815 | 3/1959 | Pluckebaum | 402/19 X |

FOREIGN PATENT DOCUMENTS

| | | | |
|---|---|---|---|
| 916526 | 8/1954 | Fed. Rep. of Germany | 402/19 |
| 157636 | 1/1921 | United Kingdom | 402/19 |
| 565972 | 12/1944 | United Kingdom | 402/19 |

*Primary Examiner*—Paul A. Bell

*Attorney, Agent, or Firm*—Quarles & Brady

[57] ABSTRACT

A carrier (10) for holding a plurality of pages (2) including a support member (13) and at least one ring (12) extending therefrom that includes a lower retention finger (20) of substantially uniform thickness and a flexible upper finger (21) of decreasing thickness. The fingers (20, 21) have free ends (22, 24) adjacent to each other and a flexible tang (25) at the free end of the flexible upper finger is positioned along one or more rigid tangs (26) at the free end of the lower retention finger.

6 Claims, 10 Drawing Figures

CARRIER FOR HINGED SUPPORT OF PAGES

This invention relates to a carrier for holding a plurality of pages or cards and including at least one ring on which the pages are hinged that is adapted for facile insertion and removal of pages.

In numerous industrial applications, workmen need to carry a supply of identification devices such as wiremarkers, pipemarkers, etc. It is known to package identification devices of this general type in book-form consisting of a plurality of pages each bearing a number of markers containing alphanumeric identification legends. The markers may be printed with a variety of legends and may often have numbers arranged in sequence to enable serial identification of different elements. A typical example is a book of pages of wiremarkers for application to electrical cables. Book-form assemblies of identification markers of this type are often made with pages sized to conveniently fit inside a person's pocket so that they can be carried to the work site.

It generally happens that the markers on one or more pages of the book are used up while other pages contain a supply of markers. It is then desirable to be able to remove the empty pages and insert replacement pages having a fresh supply of the markers. This requires the use of some form of binder for the individual pages that will permit easy removal and insertion of pages. While numerous devices for this purpose are known in the art, it is our belief that none of them provides an optimum combination of features such as convenient removal and replacement of pages, good support for the pages, and free hinging of the pages about the support elements.

With these deficiencies of the prior art constructions in mind, there is hereinafter described a new carrier for holding a plurality of pages, such as pages of adhesive identification devices, which includes at least one ring for attaching through apertures along a marginal edge of the pages, wherein the ring includes a lower retention finger and a flexible upper finger. The lower retention finger comprises the major portion of the ring and the flexible upper finger the minor portion. The fingers each have a free end adjacent the other. The flexible upper finger may be depressed inwardly of the ring so that pages can be inserted or removed through the space between the free ends of the fingers. Upon release of pressure, the upper finger returns to its storage condition and the pages may be freely hinged about the ring without interference from obstructions along the internal or external surfaces of the fingers. The flexible upper finger can be depressed in this fashion by finger pressure or by pushing a page against it when the pages are made of relatively thick or rigid material.

Our present invention is described below in the full and concise detail required under 35 U.S.C. §112 by reference to the following drawings, in which.

(A) DESCRIPTION OF FIG. 1

Figure 1:
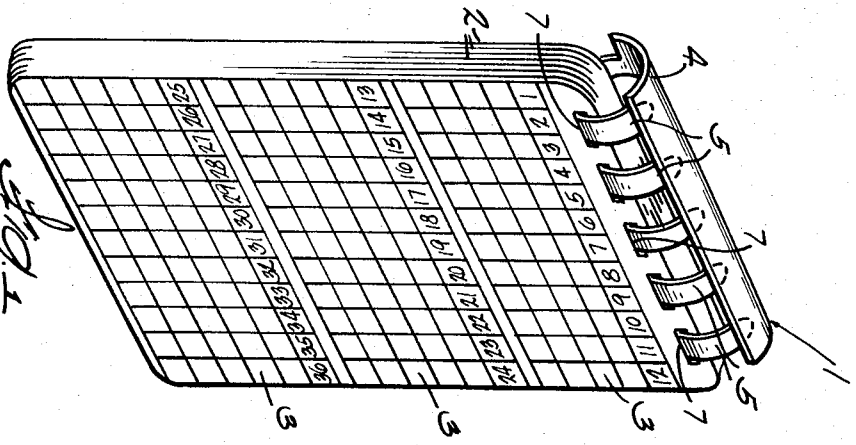
Fig. 1 PRIOR ART
FIG. 1 is a perspective view of a prior art form of ring binder used to hold together a number of pages bearing pressure sensitive adhesive wiremarkers.

FIG. 1 illustrates a typical prior art ring binder 1 which is used to bind together a plurality of cards or pages 2. The pages 2 are illustrated herein as comprising card-type pages having a release surface on which are carried wiremarkers 3 having a layer of pressure sensitive adhesive, which can be arranged in various configurations such as the three row stack arrangement of FIG. 1. The pages 2 will often carry markers having alphanumeric legends arranged in sequence; for example, the first page may carry markers having identification numerals from 1 through 36, the second may have markers with identification numerals from 37 through 72, etc.

The ring binder 1 comprises a strip of molded or formed resilient plastic having a curved panel 4 with a plurality of circular fingers 5 extending from one edge of the panel. As indicated in the drawing, the fingers 5 include an overlapping portion in order to form a series of closed rings which support the pages 2, the fingers passing through rectangular apertures 7 formed near the upper margin of the pages.

When the supply of wiremarkers on one of the pages 2 is depleted, the user often desires to replace it with a fresh page containing a new supply of the appropriate markers. It then becomes necessary to remove one of the pages from the binder 1 by separating the overlapping portions of the fingers 5 to open the rings, slide the page out from the binder, hold the fingers open in order to insert a new page, and close the fingers to retain the page on the binder. However, this is difficult to do without using a special tool, so that in a practical sense the pages are not easily replaceable. Also, it is not possible to hinge the pages to a back-to-back position with the ring binder 1 because the panel 4 precludes this action. Another disadvantage is that replacement of an inner page of the group of pages 2 carried on the binder 1 requires the removal of all pages stacked on top of it in the group, thereby further inhibiting facile replacement of pages. While the ring binder 1 has been a relatively satisfactory form of packaging for individual pages of cards of markers and the like, the above and other disadvantages experienced with the binder 1 have led to the development of the new carrier device of the present invention which has advantages of significance to users that are not attainable with the binder 1.

(B) DESCRIPTION OF FIGS. 2–10

Our new carrier 10 is illustrated in various views in FIGS. 2–7.

Figure 2:
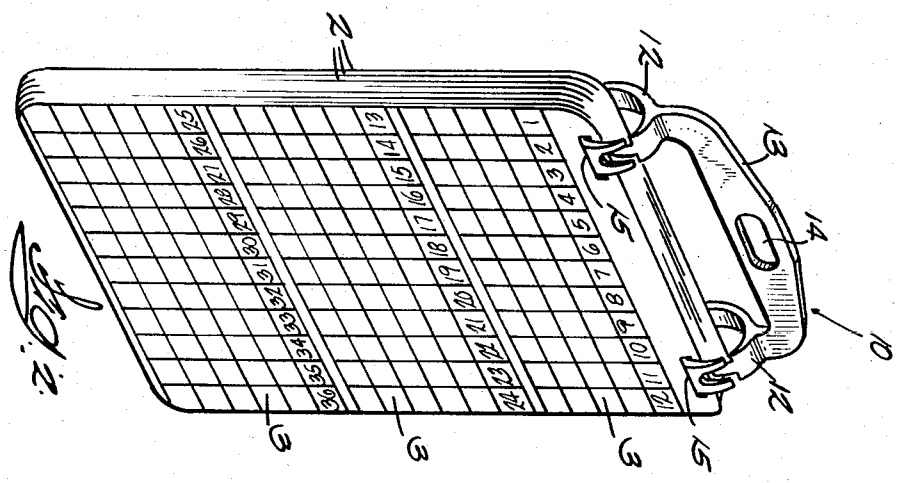
FIG. 2 is a perspective view of the new carrier of this invention employed to bind together a group of pages.

Considering FIG. 2 first, the carrier 10 comprises a pair of spaced rings 12 connected by support member 13. The support member 13 may include a central aperture 14 so that the carrier can be suspended from a belt, clip, or hanger, if desired. A number of pages 2 are supported from the rings 12, and each page has a pair of ring-engaging apertures 15 which fit about the rings.

The pages 2 carry wiremarkers 3 that can be arranged in any desired configuration on one or both faces of each page, as described above in connection with FIG. 1.

Figure 3:
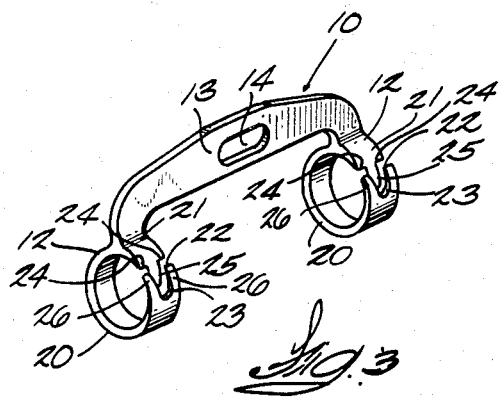
FIG. 3 is a perspective view of the carrier of FIG. 2.

Turning next to FIG. 3 which shows the carrier 10 in greater detail, the rings 12 each include a curved rigid lower retention finger 20 and a curved flexible upper finger 21 which have their free ends adjacent to but slightly spaced from one another. The free end of the lower retention finger 20 includes a centrally located U-shaped slot 23 and shoulders 22 extending from each side of the open end of the slot. The free end of the flexible upper finger 21 includes a centrally located flexible tang 25 which projects therefrom and shoulders 24 extending from each side of the root portion of the tang. The free end of the finger 20 is defined a pair of spaced rigid tangs 26 formed by the shoulders 22 and slot 23 and is spaced slightly from the free end of the finger 21 that is defined by the shoulders 24 and tang 25. The construction of the end portion of the rigid lower retention finger 20 provides a pair of spaced rigid tangs 26 which are positioned along each side, but are spaced from, the flexible tang 25 of the flexible upper finger 21.

Figure 4:
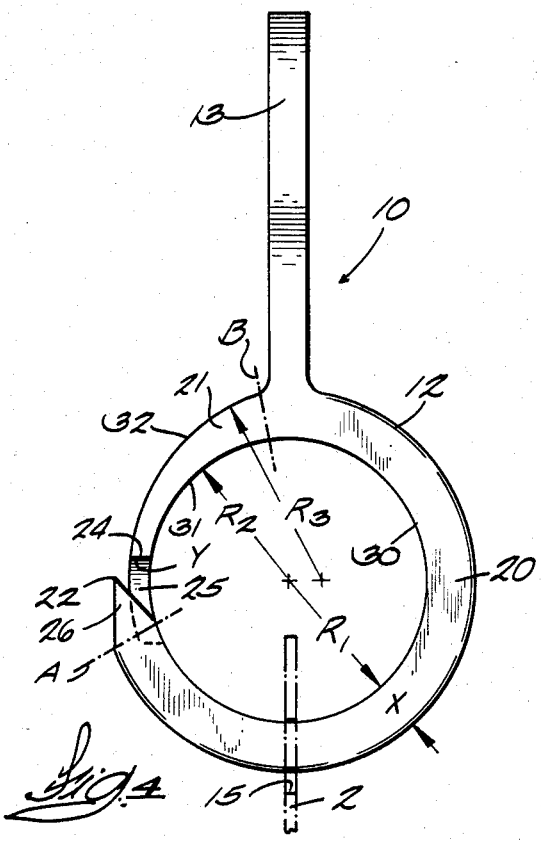
FIG. 4 is a side view of the carrier of FIGS. 2–3.
Figure 5:
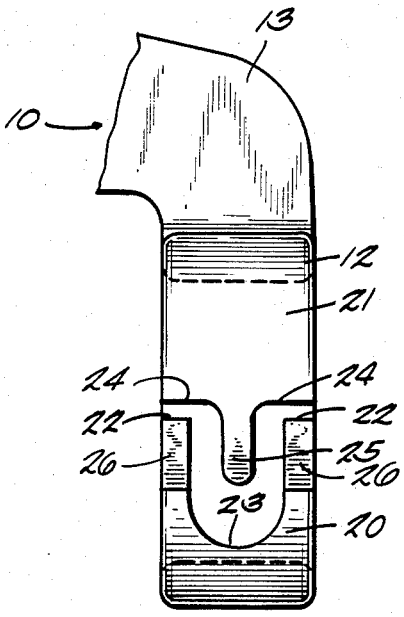
FIG. 5 is a front view of the carrier of FIGS. 2–4.

The structure of the rings 12 of binder 10 is shown in greater detail in the side and front views of FIGS. 4 and 5, to which reference should now be made. Each ring 12 is of generally circular configuration and the support member 13 is most usefully located to extend from a diameter of the rings 12, preferably from the top thereof. The lower retention finger 20 extends about approximately three quadrants of the ring and forms the major portion of the ring. The free end of the finger 20 may have a tapered or V-configuration as shown in FIG. 4 for the purpose to be described hereinafter. The remaining part of the lower finger 20, comprising its major portion, is of substantially uniform thickness "X" from the line indicated by the reference letter A to the line indicated by reference letter B in FIG. 4. The upper flexible finger 21 is integral with the finger 20 and extends about approximately one quadrant of the ring 12 to form a minor portion of the ring. Unlike the finger 20, however, the cross-sectional thickness of the finger 21 decreases from thickness "X" at its root portion connected with finger 20 along line B to a lesser thickness "Y" at the shoulders 24; the finger 21 thus is made with a tapered thickness so as to comprise a flexible finger that can be readily deflected for insertion or removal of pages. The tang 25 of the upper finger may be of the same thickness "Y" as the shoulders 24 or a lesser thickness; the tang 25 is thereby flexible, which is defined herein and in the claims as meaning it is capable of deflecting by itself or upon deflection of the upper finger 21, or both.

The inner circumferential surface 30 of the lower finger 20, which extends from line A to line B and the inner circumferential surface 31 of the upper finger 21 which extends from line B to the free end 24 and includes the inner surface of the tang 25 form a substantially circular inner cross-sectional face of the ring 12. Thus, the radius $R_1$ of the inner surface 30 of the finger 20 and the radius $R_2$ of the inner surface 31 of the finger 21 are to be substantially the same. This provides a smooth circular interior face so that pages 2 carried on the ring can be freely moved from the lower finger to the upper finger, and vice versa, without encountering any obstruction from a part of either finger, which is important to obtaining free hinging of the pages 2 about the rings 12. Therefore, the decreasing thickness of the flexible upper finger 21 from its root portion along the line B to its free end 24 is obtained by tapering or gradually reducing the radius (measured from the center of the ring) of the outer circumferential face 32 of the finger 21 instead of reducing the radius of its inner circumferential face 32. Another way to develop the reducing thickness of the upper finger 22 is to generate the curve of its outer surface 32 with a radius $R_3$ that is greater than $R_1$ and $R_2$ and offset or eccentric from the center point of $R_1$ and $R_2$ as shown in FIG. 5. As best shown in FIG. 5, the flexible tang 25 extends partially into the slot 23 of the lower retention finger 20 to lie between the rigid tangs 26.

Figure 6:
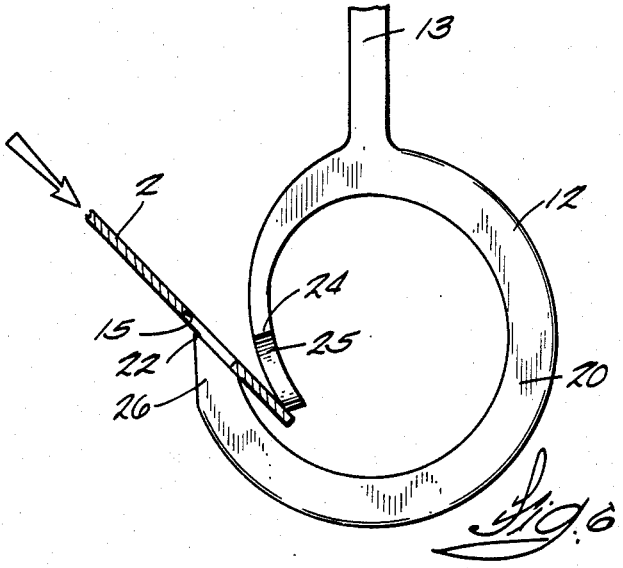
FIG. 6 is a side view of the carrier of FIGS. 2–5 illustrating its operation for the insertion or removal of a page.

The operation of the carrier 10 is illustrated in FIG. 6 in which a page 2 is shown in the process of being inserted onto a ring 12. When the page 2 is of a stiff or card-like material, the page can be pushed between the flexible tang 25 and the rigid tangs 26 so that the flexible tang 25 is displaced inwardly of the ring a small but sufficient distance equal to at least the thickness of the page 2. (Alternatively, the flexible upper finger 21 can be depressed manually, particularly when the page 2 is made of paper or flimsy material, and the page inserted between the flexible and rigid tangs.) The page is then slid between the tang 25 and the tangs 26 until its aperture 15 can be inserted onto the lower region of the retention finger 20. The retention finger 20 is of sufficient thickness "X" to support the desired number of pages 2 without deforming. The V-shaped configuration of the free end of the lower finger 20 adjacent the tang 25 is employed to facilitate the entry of a page into the space between the tang and the lower finger, as well as to facilitate the exit of a page therefrom. Removal of a page from the carrier 10 is also a simple process. A page is moved to position the apertures 15 alongside the flexible tangs 25 and the flexible tangs are deflected by pushing its page against them or manually, following which the page is pushed between the tangs 25 and 26 of the fingers 21 and 20, respectively, and then slid sideways until the apertures clear the rings 12.

Figure 7:
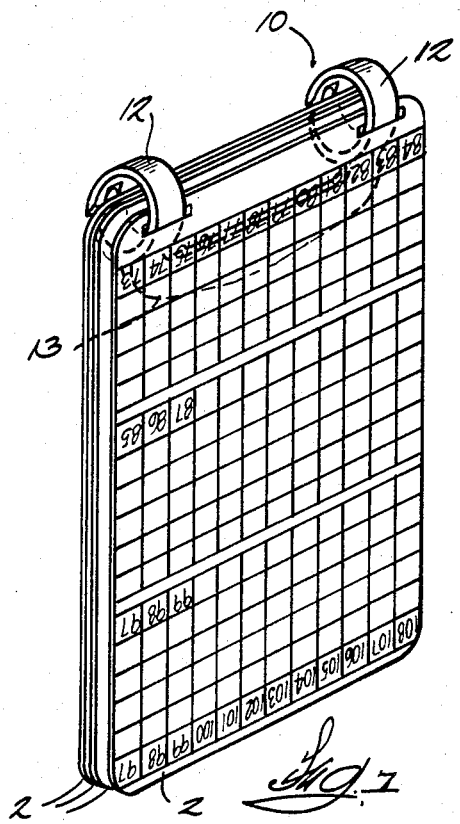
FIG. 7 is a side view of the carrier of FIGS. 2–6 with the pages folded over to have a portion of the carrier between the pages.

An important advantage of the carrier 10 is illustrated in FIG. 7. The pages 2 can be hinged about the rings 12 so that some are located on one side of the support member 13 and others are located on the opposite side. This enables a user to position any selected page uppermost among the group of pages supported on the carrier. This is particularly advantageous when working with wiremarkers from a specific page as the entire assembly can be folded into a flat condition with the specific page on top and put in a shirt pocket, for example, so that the user does not have to hunt for the page when it is next desired to select wiremarkers therefrom. The inside diameter of the rings 12 can be sized such that all of the pages can be put on one or the other side of the support member 13 in order to best exploit this advantage of the carrier 10.

EXAMPLE

A carrier 10 was constructed of molded polypropylene in the configuration shown in FIGS. 2–17 that was about 2.5 inches long. $R_1$ and $R_2$ of the two rings 12 of the carrier were 0.225 inches. The lower retention finger had a thickness "X" of 0.075 inches and the flexible upper finger 21 had the same thickness at its root portion and tapered to 0.030 inches thick at the shoulders 24 and tang 25. The free ends of the fingers 20 and 21 were 0.030 inches apart; the slot 23 was 0.20 inches deep and the tang 25 was 0.10 inches long, both measured vertically. The carrier was suitable for holding pages 2 of card material (carrying wiremarkers) that were 3.25 inches wide and 5.75 inches long. The rings were of a size suitable for holding up to 15 pages 13 mils thick or up to 12 pages 17 mils thick. Upon testing, the carrier proved to operate in the manner described above and the addition or removal of pages was demonstrably easier and more convenient than with the prior art binder 1. The pages could be freely hinged about the rings 12 so that any page could be easily reached for removal of a wiremarker or for replacement of the page. The carrier was deemed to successfully meet the objectives of this invention.

The carrier 10 as illustrated in FIGS. 2–7 is presently considered to be the most useful embodiment of our present invention. However, alternate constructions are possible and some are illustrated in FIGS. 8–10.

Figure 8:
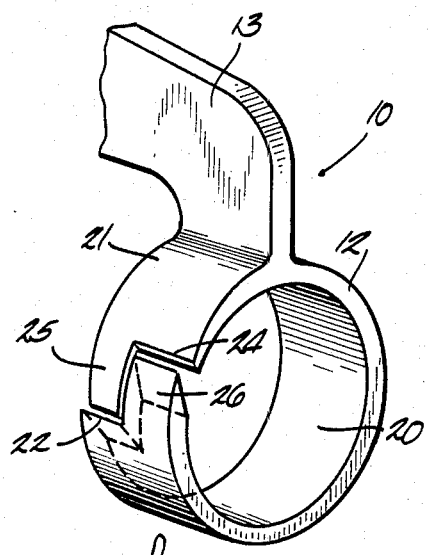
FIG. 8 is a partial perspective view of a second embodiment of the new carrier of this invention.

In the embodiment of FIG. 8, flexible tang 25 at the free end of the flexible upper finger 21 is positioned along one side of the finger 21 rather than being centrally located as in the embodiment of FIGS. 2–7, and there is a single shoulder 24 at the root portion of the tang 25. A single rigid tang 26 is formed at the free end of the lower retention finger 20 at the side opposite to the tang 25 so as to be positioned alongside the flexible tang 25 and there is a single shoulder 22 at the root portion of the rigid tang 26.

Figure 9:
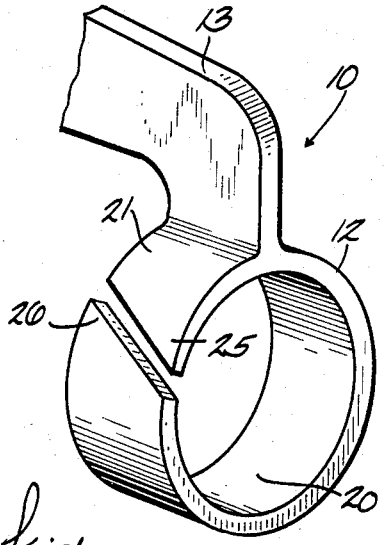
FIG. 9 is a partial perspective view of a third embodiment of the new carrier of this invention.

FIG. 9 illustrates another alternative embodiment wherein the free end of the lower retention finger 20 extends at an angle across the face of the ring, and the free end of the flexible upper finger 21 extends at a similar angle across the ring. The tip portion of the lower retention finger thus defines a rigid tang 26 and the tip portion of the flexible upper finger defines a flexible tang 25, both located along the spaced free ends of the fingers 20 and 21 of the ring 12.

Figure 10:
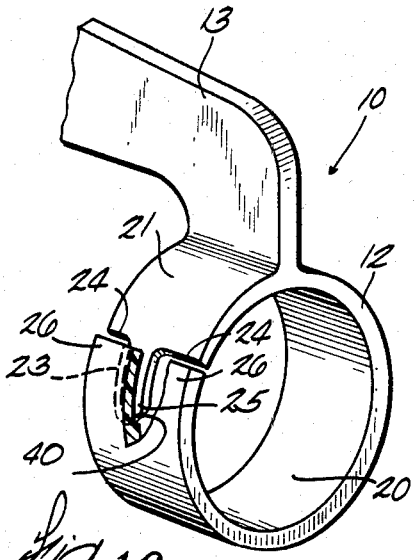
FIG. 10 is a partial perspective view, with a portion broken away, of a fourth embodiment of the new carrier of this invention.

In the third alternate embodiment of FIG. 10, the free end of the lower retention finger 20 is constructed to include a slot 23 as in the embodiment of FIGS. 2–7. However, the slot 23 in the version of FIG. 10 does not extend all the way through the lower retention finger but, instead, is formed as a blind slot opening along the inner surface 30 of the retention finger 20 and extending only part way through the thickness of the finger. Flexible tang 25 extending from the free end of the flexible upper finger 21 fits into the slot 23 and is displaceable from the slot inwardly of the ring for the insertion or removal of pages. Thus, the embodiment of FIG. 10 includes a pair of rigid tangs 26 at the free end of the lower retention finger 20 positioned along either side of the flexible tang 25 extending from the upper finger 21, but the two tangs 26 are connected by a thin web 40 of the material of the lower finger instead of being completely separate from one another as in FIGS. 2–7.

The operation of the rings 12 illustrated in FIGS. 8–10 is the same as that described inoonnection with FIGS. 2–7.

In the embodiments of FIGS. 2–10 as illustrated and described herein, the rigid lower retention finger 20 extends around about three quadrants of a ring 12 and the flexible upper finger extends around about one quadrant of the ring. We have found that it is especially advantageous to locate the free ends of the hinges 20 and 21 at about 90° from a support member 13. This facilitates the insertion and removal of pages onto/from the rings and provides a maximum length of the retention finger 20 for storage of pages.

The new carrier 10 can be injection molded of various suitable plastic materials such as nylon, polypropylene, polyethylene, etc. It can be made in various sizes in accordance with the number of pages to be supported on it. The carrier 10 of this invention can incorporate one or more rings 12, depending on the width of the pages to be supported, each ring including a lower retention finger of generally uniform thickness which is sufficient to support the desired number of pages without bending, and a flexible upper finger integral therewith. The new carrier offers a number of significant advantages to users in addition to those described above. It provides secure support of a number of pages in a manner which precludes the pages from being inadvertently dislodged from the rings. At the same time, however, new pages can be easily inserted onto the rings of the carrier and pages can be easily removed therefrom to permit convenient addition of new pages or replacement of old pages from which a supply of wiremarkers, or other pressure sensitive adhesive devices, has been exhausted. This can be accomplished without having to remove any unnecessary pages as only the selected page needs to be removed or inserted with our new carrier. While the rings of the carrier incorporate two finger portions which are separated from one another along free ends, provision is made for blocking the space between the free ends to prevent inadvertent removal of cards by the tang and slot arrangement described above. The flexible upper finger of each ring has a reduced thickness from its root portion connected to the retention finger to its free end, but the internal radius of the flexible finger and the retention finger is kept constant to thereby enable individual pages to be hinged to various positions on the ring and to be readily moved from one finger to the other; this permits ready access to any of the pages supported on the carrier so that, for example, a user can easily reach a middle or intermediate page for the removal of identification devices therefrom. It should be understood that various changes and modifications in the form and construction of the several parts of the carrier described above may be made and substituted for those herein shown and described without departing from the nature and principles of this invention, and such changes and modifications are intended to be encompassed within the scope of the appended claims.

We claim:

1. A carrier for holding a plurality of pages having ring-engaging apertures along an edge portion comprising, in combination:

(1) a support member;

(2) at least one ring extending from the support member and including (a) a rigid lower retention finger extending about a major portion of the ring, and (b) a flexible upper finger integral with the retention finger and extending about a minor portion of the ring;

(3) the lower retention finger and the flexible upper finger each having a free end located adjacent to and spaced from one another;

(4) the free end of the lower retention finger being defined by at least one rigid tang and the free end of the upper finger being defined by a flexible tang extending alongside of the rigid tang; and (5) the inner surface of the lower retention finger and the inner surface of the flexible upper finger each having substantially the same radius, the lower retention finger having a substantially constant thickness, and the flexible upper finger decreasing in thickness from its root portion connected to the retention finger to its free end to form a tapered flexible upper finger which is displaceable inwardly relative to the retention finger to provide a space between the two free ends of the fingers through which pages can be inserted onto and removed from the ring.

2. A carrier according to claim 1, wherein:

the free end of the lower retention finger is defined by a pair of spaced rigid tangs and the flexible tang of the flexible upper finger is positioned therebetween.

3. A carrier according to claim 1, wherein:

the free end of the lower retention finger is defined by a pair of spaced rigid tangs connected by a thin web of the lower retention finger, and the flexible tang of the flexible upper finger is positioned between the rigid tangs and under the thin web along the inner surface of the lower retention finger.

4. A carrier according to claim 1, comprising:

a pair of rings extending from the support member and spaced from one another.

5. A carrier according to claim 1, 2, 3 or 4 wherein:

the free end of the lower retention finger is cross-sectionally tapered to facilitate insertion of pages onto a ring and removal of pages therefrom.

6. A carrier according to claim 1, 2, 3 or 4 wherein:

the free ends of the rigid lower retention finger and flexible upper finger are positioned about 90° from the support member.

* * * * *